US005372543A

United States Patent [19]

Steele

[11] Patent Number: 5,372,543

[45] Date of Patent: Dec. 13, 1994

[54] VENT FOR ENCLOSURES

[75] Inventor: Edward A. Steele, Chicago, Ill.

[73] Assignee: S&C Electric Company, Chicago, Ill.

[21] Appl. No.: 44,333

[22] Filed: Apr. 7, 1993

Related U.S. Application Data

[62] Division of Ser. No. 761,582, Sep. 18, 1991, Pat. No. 5,201,879.

[51] Int. Cl.[5] ..... F24F 7/00; F24F 13/20

[52] U.S. Cl. ..... 454/184; 174/16.1; 454/276

[58] Field of Search ..... 52/633, 673; 174/16.1; 361/383, 384; 454/48, 184, 275, 276, 367

[56] References Cited

U.S. PATENT DOCUMENTS

| | | | |
|---|---|---|---|
| 786,203 | 3/1905 | Gailey | 454/48 X |
| 3,157,730 | 11/1964 | Willox | 174/16.1 |
| 3,210,456 | 10/1965 | Skubal | 174/16.1 |
| 4,073,000 | 2/1978 | Krejsa | 361/344 |
| 4,557,095 | 12/1985 | Rice et al. . | |
| 5,168,171 | 12/1992 | Tracewell | 361/384 X |

FOREIGN PATENT DOCUMENTS

| | | | |
|---|---|---|---|
| 366256 | 4/1938 | Italy | 52/673 |

OTHER PUBLICATIONS

"Perforated Metals" Advertisement, The Harring Ton & King Co., New York, N.Y., Jul. 1940, p. 49.

*Primary Examiner*—Harold Joyce
*Attorney, Agent, or Firm*—James V. Lapacek

[57] ABSTRACT

A vent arrangement for enclosures that prevents the penetration of a pry bar. The vent arrangement includes a first predetermined pattern of openings of predetermined shape and dimensions provided at the exterior wall of the enclosure. The dimensions of the openings and the spacing between the openings are determined relative to the pry bar and the material in which openings are formed, such that the pry bar cannot fully enter the openings and such that the portion of the pry bar that can be applied to the openings does not cause any substantial deformation of the material surrounding the openings that could permit widening of the openings so as to allow full entry of the tip of the pry bar. In a preferred embodiment, to permit the maximum percentage area of openings within the pattern of openings while achieving the desired tamper-resistant characteristics, the first predetermined pattern of openings includes staggered rows of openings such that the openings of adjacent rows are not aligned.

5 Claims, 2 Drawing Sheets

VENT FOR ENCLOSURES

This is a division of application Ser. No. 07/761,582, filed Sep. 18, 1991 U.S. Pat. No. 5,201,879.

BACKGROUND OF THE INVENTION

1. Field of the Invention

The present invention relates generally to the field of ventilation devices and more particularly to an improved vent that provides desirable venting, prevents water entry, and prevents the penetration of a pry bar or a probe wire beyond the vent.

2. Description of the Related Art

Equipment enclosures are provided to prevent access to the enclosed equipment by unauthorized people and also provide for the protection of the enclosed equipment from the environment. Vents for enclosures are provided to prevent the buildup of moisture and heat inside the enclosures. The venting arrangement, therefore, must provide for the free passage of air, prevent water entry, and prevent access to the enclosure by tampering. For example, tampering may occur by the attempted insertion of a variety of objects into the vent openings such as sticks or elongated metal members in the form of pry bars or wires. Accordingly, to the fullest extent possible, the venting arrangement should deter the entry by animals or unauthorized persons regardless of their determination and persistence. Of course, it is not possible to make any enclosure totally impenetrable, but the enclosure should be tamper resistant to the limits of technical feasibility.

Standards such as ANSI C57.12.28 aid in the development of desirable standards to resist tampering. Such standards are developed in terms of specific tests involving specific tampering items or devices that might be expected to be utilized by tamperers. Of course, while the tampering tests encompassed by the standards involve persistent illegal conduct, it is still important to manufacture equipment so as to attempt to protect such tamperers from themselves and their conduct, as well as to protect small children who may come along after the tamperer. Thus, the standards and the tests enumerated therein are performed to determine the effectiveness of a comprehensive integrity system. One sequence of specific tests involve the use of a pry bar of predetermined dimensions including a wedge shaped chisel tip of 2 inches in length that tapers from 0.4 into to 0.1 inch in thickness, with a uniform width of 0.5 inch. Additionally, a probe wire is utilized that is bare number 14 AWG soft-drawn solid copper wire 10 feet long. For the sequence test, the pry bar is utilized to attempt to gain entry and thereafter the wire probe is manipulated in an attempt to gain entry. Push and pull tools are also defined for various other tests.

Examples of various tamper-resistant enclosures are shown in U.S. Pat. Nos. 4,102,475 and 4,963,696. A vent structure for high-voltage electrical equipment is shown in U.S. Pat. No. 4,073,000 and at pages 5 and 23 of Descriptive Bulletin 621-30 dated Aug. 25, 1986 by S&C Electric Company, Chicago, Ill. That vent includes a pattern of openings or louvers in the exterior panel of the enclosure and a recessed baffle with louvers on the interior surface of the panel. Additionally, wire-mesh screening is provided internal to the recessed baffle.

While these arrangements have been effective for their intended purposes, it is always extremely desirable to provide improved tamper-resistant vent arrangements for enclosures in an attempt to advance the state of the art and to prevent unauthorized, dangerous, and illegal ingress to equipment.

SUMMARY OF THE INVENTION

Accordingly, it is a principal object of the present invention to provide an improved tamper-resistant vent arrangement for an enclosure.

This and other objects of the present invention are efficiently achieved by a vent arrangement for enclosures that prevents the entry of water into the enclosure and that also prevents the penetration of a pry bar or probe wire. The vent arrangement includes a first predetermined pattern of openings of predetermined shape and dimensions provided at the exterior wall of the enclosure. The dimensions of the openings and the spacing between the openings are determined relative to the pry bar and the material in which openings are formed, such that the pry bar cannot fully enter the openings and such that the portion of the pry bar that can be applied to the openings does not cause any substantial deformation of the material surrounding the openings that could permit widening of the openings so as to allow full entry of the tip of the pry bar. In a preferred embodiment, to permit the maximum percentage area of openings within the pattern of openings while achieving the desired tamper-resistant characteristics, the first predetermined pattern of openings includes staggered rows of openings such that the openings of adjacent rows are not aligned.

The vent arrangement also includes a baffle plate spaced behind the predetermined pattern of openings. The baffle plate includes facilities to freely pass air, but prevents the ingress of any water than may enter through the first predetermined pattern of openings. The baffle plate is arranged to direct all such water out through the bottom of the first predetermined pattern of openings.

In a preferred arrangement, the vent arrangement also includes facilities to prevent the ingress of a probe wire beyond the baffle plate and into the enclosure even if the probe wire passes into the venting arrangement beyond the first predetermined pattern of openings. In a specific embodiment, this is achieved by the provision of a double layer of wire-mesh screen or the like disposed within the vent arrangement between the first predetermined pattern of openings and the baffle plate. The double layer of wire-mesh screen is arranged in a closed path in the shape of a cage or the like.

BRIEF DESCRIPTION OF THE DRAWING

The invention, both as to its organization and method of operation, together with further objects and advantages thereof, will best be understood by reference to the specification taken in conjunction with the accompanying drawing in which.

DETAILED DESCRIPTION

Figure 1:
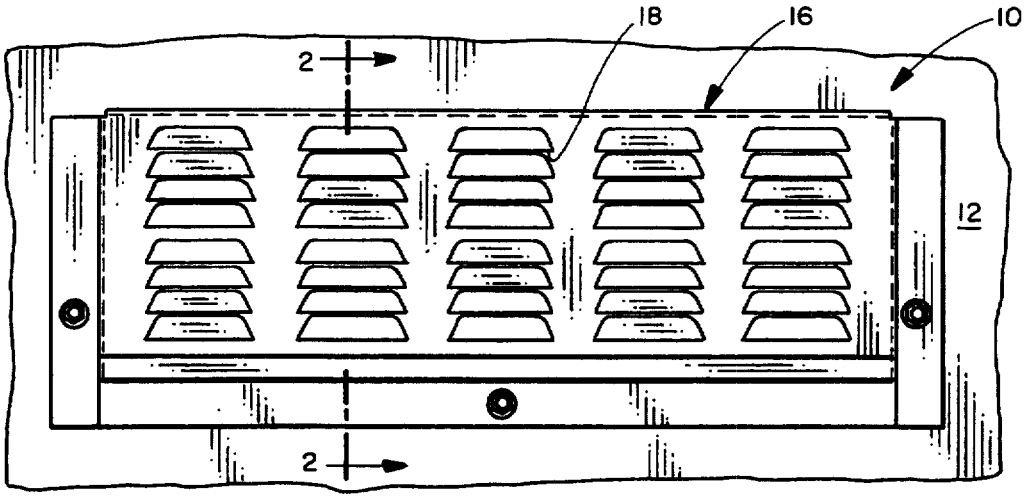
FIG. 1 is a rear elevational view of the vent arrangement of the present invention from the interior of an equipment enclosure.
Figure 3:
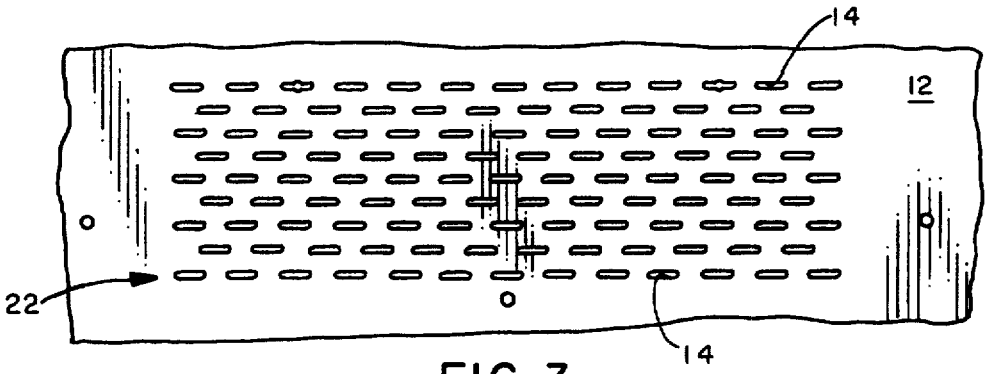
FIG. 3 is a front elevational view of the vent arrangement of FIG. 1 illustrating the predetermined pattern of openings in the wall of the equipment enclosure.
Figure 4:
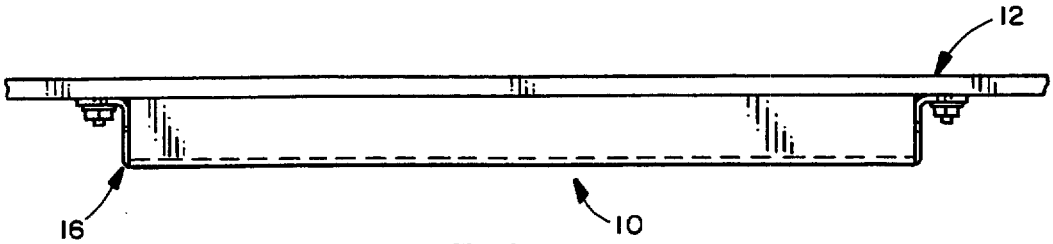
FIG. 4 is a top plan view of the vent arrangement of FIG. 1.
Figure 2:
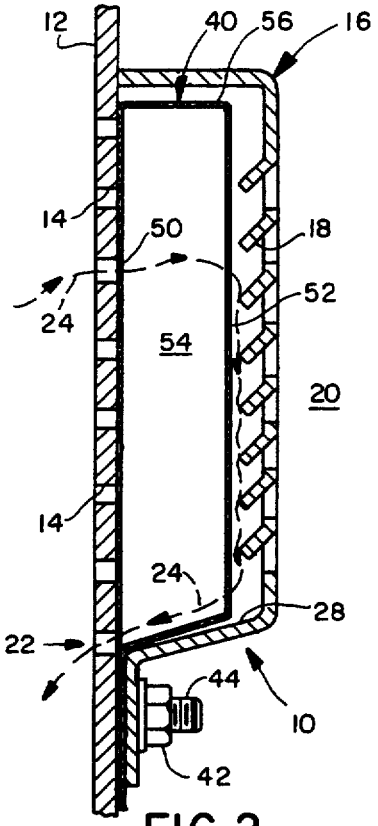
FIG. 2 is an enlarged sectional view taken along the line 2—2 of FIG. 1.

Referring now to FIGS. 1 and 2, the vent arrangement 10 of the present invention is illustrated in conjunction with a wall 12 of an enclosure. In a specific embodiment and referring now additionally to FIG. 3, the vent arrangement includes a first predetermined pattern of openings 14 formed through the wall 12 and a baffle plate 16 affixed to the inner surface of the wall 12. The pattern of openings 14 is formed by staggered rows of the openings 14 such that the distance between the openings 14 in any column is double the distance of the row spacing. In a specific embodiment, the openings 14 are approximately 0.5 inch by ⅛ inch rectangles with rounded ends (obrounds) arranged with the longer dimension along the width of the vent 12. Additionally, the openings 14 are spaced approximately one inch on center in each row, and the rows are arranged such that there is an approximate space of 5/16 inch between the openings of two adjacent rows. Further, the openings 14 are not positioned so closely to the side and top edges of the baffle plate 16 to permit the tip of any inserted object to bear directly against any portions of the vent arrangement immediately behind the openings 14.

Thus, the tip of a pry bar such as the one specified in ANSI C57.12.28 cannot fully enter through the openings 14 and thus the full prying force cannot be exerted on the material of the wall 12 surrounding the openings 14; i.e., no leverage can be obtained since the full tip of the pry bar cannot enter through the openings 14. Additionally, the distances between the openings 14 and the staggered pattern thereof prevent significant deformation in any of the material of the wall 12 in the vicinity of the openings 14. The baffle plate 16 also includes a pattern of openings or louvers 18 that are arranged to freely permit the passage of air through the enclosure wall 12 and into the interior of the enclosure at 20 but are inclined so as to deflect and route any water entering through the openings 14 down to the bottom of the baffle plate 16 and back out the exterior of the wall 12 via the lowest row 22 of openings 14 of the predetermined pattern of openings. An illustrative path of such windswept rain is indicated at 24. The baffle plate includes a suitable tapered lower edge or lip at 28 for this purpose. As can be seen in FIG. 2, the baffle plate 16 is positioned relative to the lower row 22 of the openings 14 so that the water is appropriately directed to the openings 14.

Figure 5:
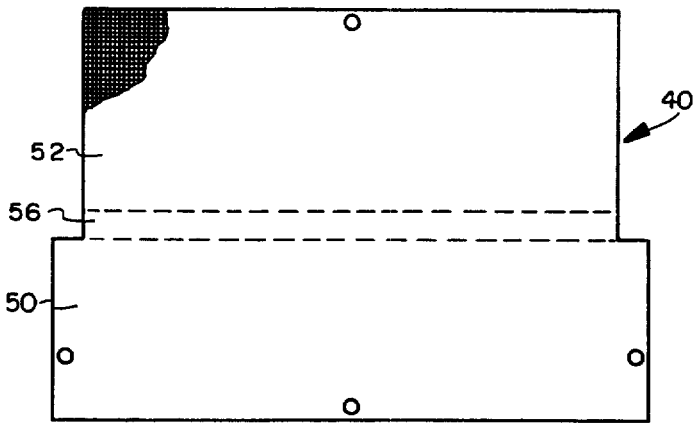
FIG. 5 is a plan view of a screen component of the vent arrangement of FIGS. 1 and 2.
Figure 6:
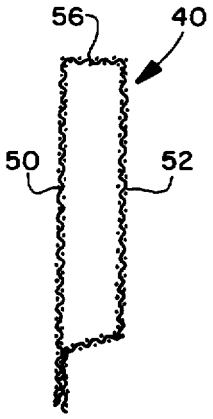
FIG. 6 is a right side elevational view of the screen component of FIG. 5 in an assembled position.

Considering additional features of the venting arrangement and with additional reference to FIGS. 5 and 6, to prevent the penetration of a probe wire beyond the baffle plate 16 and into the interior 20 of the enclosure, a screen 40 of wire mesh is disposed within the interior of the vent arrangement 10. The screen 40 is retained in the appropriate position by the placement of the screen 40 intermediate the interior of the wall 12 and the baffle plate 16 along the lower edge. At this lower edge, the baffle plate 16 is affixed to the interior of the wall 12 by threaded fasteners 42 cooperating with threaded studs 44 carried by the wall 12. As seen in FIG. 1, the baffle plate 16 is also secured to the wall 12 via additional fasteners 42, 44 along the side flanges of the baffle plate 16.

Figure 7:
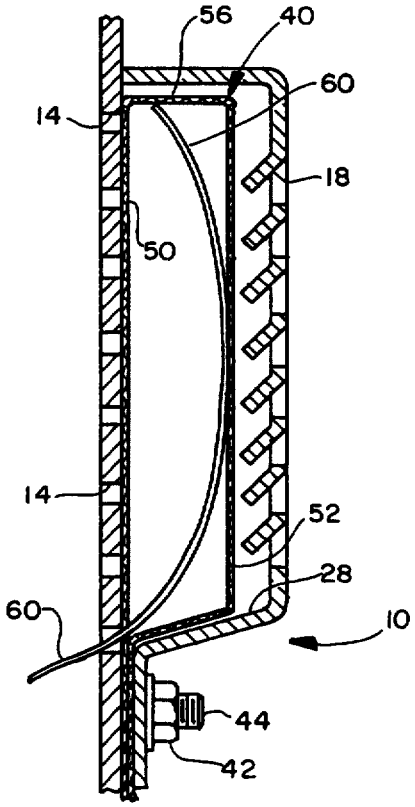
FIG. 7 is an enlarged sectional view similar to FIG. 2 and illustrating the attempted entry by a probe wire.

The pattern of openings 14 should normally be sufficient to prevent any damage by a pry bar to the screen 40 that would cause an opening large enough for the passage of a probe wire. However, it may be possible for some prying tools under certain circumstances to exert sufficient force against the screen 40 to cause a small opening therein insufficient to pass the pry bar but sufficient to pass a probe wire. This could especially be true at the lower row 22 of the openings 14. Unfortunately, it is not technically feasible to modify the relative positions of the row 22 and the screen 40 so as to avoid this possibility because of the need to direct the flow of water out the row 22 of openings 14. To this end and for additional integrity, the screen 40 is formed with a front section 50 and a rear section 52. Referring now additionally to FIG. 7, if a probe wire 60 is able to be inserted past the front section 50 and into the interior of the baffle at 54, the probe wire 60 will encounter the rear section 52 of the screen 40 which will not permit the penetration of the probe wire 60 into the interior of the enclosure at 20. Instead, the probe wire 60 will be directed along the surface of the rear section 52. To this end, the screen 40 also includes a top portion 56 such that the probe wire 60 cannot penetrate beyond the screen 40 in any circumstance. In a preferred embodiment, the screen 40 is fabricated as shown in FIGS. 5 and 6 from a single sheet of material and formed in a closed path as shown in FIG. 6 so as to define a cage or the like in the shape of a closed polygon in cross section. The screen 40 functions as a double wall of screen mesh that is closed at top and bottom to prevent a circuitous path entry over or under either wall. Thus, while the illustrated arrangement is preferred for ease of manufacture and also performance of desired function, it should be realized that other specific configurations are also possible so long as the walls of mesh are secured at top and bottom to prevent entry; i.e., the walls of mesh at 50 and 52 in combination with the other vent components defining a closed volume.

While there have been illustrated and described various embodiments of the present invention, it will be apparent that various changes and modifications will occur to those skilled in the art. For example, while the illustrated pattern of openings 14 is preferable from a manufacturing and aesthetic perspective, other pattern openings of other shapes are also possible to achieve the object of the present invention regarding the prevention of entry or damage by a pry bar; i.e., different arrangements of the openings 14 are possible as well as patterns of circular holes. However, it is felt that the pattern of openings 14 provides an optimum percentage area of openings while preserving the integrity of an enclosure wall 12 fabricated from 11-gauge steel while also providing desirable aesthetics and a minimal number of openings. Accordingly, it is intended in the appended claims to cover all such changes and modifications that fall within the true spirit and scope of the present invention.

What is claimed and desired to be secured by Letters Patent of the United States is:

1. A vent structure for an enclosure having an exterior surface of predetermined structural characteristics, the vent structure to resist tampering from a pry bar of predetermined dimensions including a tapered tip with dimensions of height h and width w where w is on the order of approximately 5h, the vent structure comprising means for defining a predetermined pattern of openings of predetermined shape on the exterior surface of the enclosure, said predetermined shape being an elongated, generally rectangular slot with rounded ends and having an overall width W and an overall height H, where W is substantially equal to w and H is generally equal to or slightly greater than h such that the tapered tip of the pry bar of dimensions h by w cannot enter through said slot, said predetermined pattern including staggered rows of said openings such that the distance between said openings in columns is double the distance of the spacing between rows, the spacing between adjacent openings in each row and between rows being determined by the predetermined structural characteristics of the exterior surface so as to substantially prevent deformation of the vent structure by the pry bar.

2. The vent structure of claim 3 wherein the spacing between adjacent openings in each row is approximately in the range of 2H and W.

3. A vent structure to resist tampering from a pry bar of predetermined dimensions including a tapered tip with dimensions of height h and width w where w is on the order of approximately 5h, the vent structure comprising a generally planar surface and means for defining a predetermined pattern of openings of predetermined shape in said generally planar surface, said predetermined shape being an elongated, generally rectangular slot with rounded ends and having an overall width W and an overall height H, where W is substantially equal to w and H is generally equal to or slightly greater than h such that the tapered tip of the pry bar of dimensions h by w cannot enter through said slot, said predetermined pattern including staggered rows of said openings such that the distance between said openings in columns is double the distance of the spacing between rows, the spacing between adjacent openings in each row being approximately in the range of 2H and W.

4. The vent structure of claim 3 wherein for the exterior surface being fabricated of 11-gauge steel and for h equal to 1/10 inch and w equal to ½ inch, W is approximately ½ inch and H is approximately ⅛ inch, the spacing between said openings in adjacent rows being approximately 5/16 inch and the spacing between adjacent openings in each row being approximately ½ inch.

5. A vent structure for an enclosure having an exterior surface of predetermined structural characteristics, the vent structure to resist tampering from a pry bar of predetermined dimensions including a tapered tip with dimensions of height h and width w where w is on the order of approximately 5h, the vent structure comprising means for defining a predetermined pattern of openings of predetermined shape on the exterior surface of the enclosure, said predetermined shape being an elongated, generally rectangular slot with rounded ends and having an overall width W and an overall height H, where W is substantially equal to w and H is generally equal to or slightly greater than h such that the tapered tip of the pry bar of dimensions h by w cannot enter through said slot, said predetermined pattern including staggered rows of said openings such that the distance between said openings in columns is double the distance of the spacing between rows, the spacing between adjacent openings in each row and between rows being determined by the predetermined structural characteristics of the exterior surface, the exterior surface being fabricated of 11-gauge steel, for h equal to 1/10 inch and w equal to ½ inch, W is approximately ½ inch and H is approximately ⅛ inch, the spacing between said openings in adjacent rows being approximately 5/16 inch and the spacing between adjacent openings in each row being approximately ½ inch.

* * * * *